US010290293B2

(12) United States Patent
Cordourier Maruri et al.

(10) Patent No.: US 10,290,293 B2
(45) Date of Patent: May 14, 2019

(54) SYSTEMS, APPARATUS, AND METHODS FOR DRONE AUDIO NOISE REDUCTION

(71) Applicant: Intel Corporation, Santa Clara, CA (US)

(72) Inventors: Hector Cordourier Maruri, Guadalajara (MX); Jonathan Huang, Pleasanton, CA (US); Paulo Lopez Meyer, Zapopan (MX); Rafael De La Guardia Gonzalez, Guadalajara (MX); David Gomez Gutierrez, Tlaquepaque (MX); Rodrigo Aldana Lopez, Zapopan (MX); Leobardo Campos Macias, Guadalajara (MX); Jose Parra Vilchis, Guadalajara (MX); Jose Camacho Perez, Guadalajara (MX); Julio Zamora Esquivel, Zapopan (MX)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/806,741

(22) Filed: Nov. 8, 2017

(65) Prior Publication Data

US 2019/0043465 A1 Feb. 7, 2019

(51) Int. Cl.

| | |
|---|---|
| ***G10K 11/16*** | (2006.01) |
| ***H04R 3/00*** | (2006.01) |
| ***G10K 11/175*** | (2006.01) |

(52) U.S. Cl.

CPC .... *G10K 11/175* (2013.01); *G10K 2210/1281* (2013.01)

(58) Field of Classification Search

CPC ..... B64C 27/54; B64C 2201/024; B64C 2201/027; B64C 2201/108; G10K 11/16; G10K 11/175; G10K 11/178; G10K 2210/108; G10K 2210/121; G10K 2210/1281; H04R 3/00; H04R 29/00; G10L 21/0208; G10L 21/2016

See application file for complete search history.

(56) References Cited

U.S. PATENT DOCUMENTS

| | | | | |
|---|---|---|---|---|
| 7,035,796 | B1 * | 4/2006 | Zhang | G10L 21/0208 704/226 |
| 2002/0117579 | A1 * | 8/2002 | Kotoulas | F16F 15/02 244/1 N |
| 2005/0201570 | A1 * | 9/2005 | Honji | G10K 15/02 381/86 |
| 2012/0179294 | A1 * | 7/2012 | Sasai | B25J 9/1694 700/254 |
| 2014/0079234 | A1 * | 3/2014 | Butts | G10L 21/0208 381/71.6 |
| 2016/0083073 | A1 * | 3/2016 | Beckman | G09F 9/33 40/463 |
| 2017/0274993 | A1 * | 9/2017 | Beckman | B64C 39/024 |

* cited by examiner

*Primary Examiner* — Thang V Tran
(74) *Attorney, Agent, or Firm* — Hanley, Flight and Zimmerman, LLC

(57) ABSTRACT

Methods, systems, and apparatus for audio noise reduction from a drone are disclosed. An example apparatus includes a first sensor to gather acoustic data and a second sensor to gather rotational motion data of a rotor. The example apparatus also includes an analyzer to match the rotational motion data to a filter and filter the acoustic data using the filter. The analyzer also is to generate an audio signal based on the filtered acoustic data.

24 Claims, 8 Drawing Sheets

SYSTEMS, APPARATUS, AND METHODS FOR DRONE AUDIO NOISE REDUCTION

FIELD OF THE DISCLOSURE

This disclosure relates generally to drones, and, more particularly, to methods, systems, and apparatus for drone audio noise reduction.

BACKGROUND

Current drone rotor blades typically generate a significant amount of noise. Due to the rotor noise, commercially available drones only record video without any audio, or an audio track is obtained from a separate channel.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Drones produce self-generated noise due to the rotation of rotors. As used herein, rotors refer rotating elements of drones including, for example, rotor blades, propellers, propeller blades, etc. Noise from the motors and rotors often overwhelms the capturing of desired sound sources, resulting in a severely low signal to noise ratio (SNR).

Techniques to reduce noise detected from drones have been attempted in the past. For example, systems have used a single directional microphone in which a fixed directive pattern allows reduction of noise sources. However, the fixed directionality of a single directional microphone limits the geographic or positional scope of events for which audio is being gathered. Enhancing coverage using a single direction microphone requires excess mechanical steering, which negatively impacts cost, weight, and power consumption of the drone. Microphone arrays and digital beamforming have also been used. Array signal processing also allows directive patterns and hence noise reduction. However, a microphone array and digital beamforming increase hardware cost, weight, computing requirements, and power consumption.

Disclosed herein are advancements to drone acoustic signal technology, particularly with respect to the reduction of audio noise generated by the drone. As disclosed herein, rotor speed sensors gather rotational motion data including, for example, revolutions-per-minute (RPM) data, which is matched to a pre-defined filter such as, for example, a Wiener filter, for best noise reduction with lowest complexity and computing overhead. The pre-defined filters have been previously calibrated for different rotor speeds to optimize noise cancellation. What remains after noise reduction are acoustic signals from the environment external to the drone that are indicative of, for example, the presence and movements of a crowd of people, vehicles, other drones, etc. RPM data is used throughout this disclosure but any suitable rotational motion data may be used including, for example, revolutions-per-second, radians per second, and/or other measures or rotational frequency, rotational speed, angular frequency, and/or angular velocity.

Figure 1:
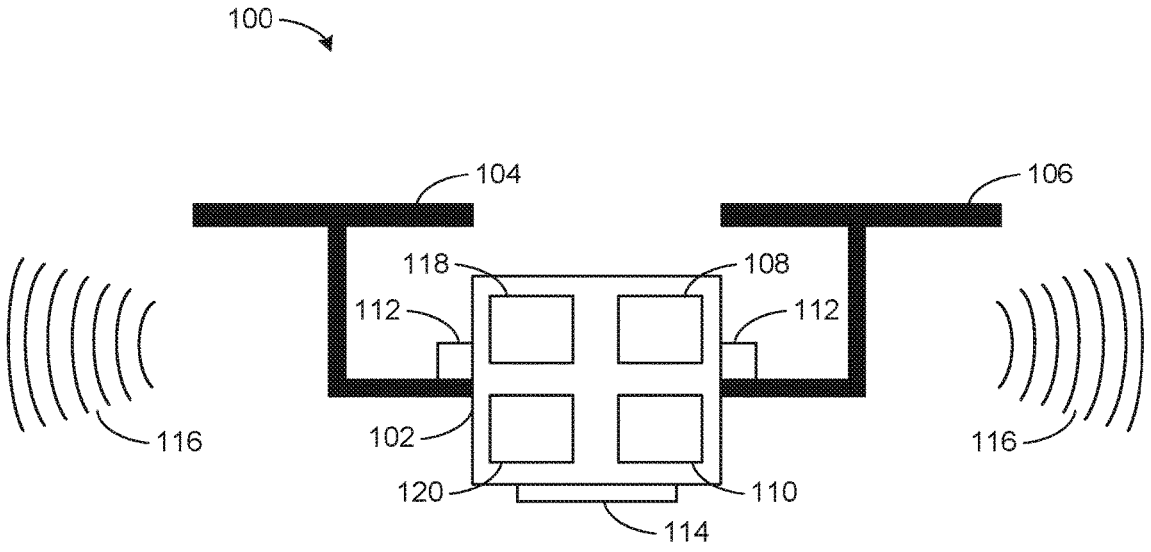
FIG. 1 is a schematic illustration of an example drone in accordance with the teachings of this disclosure.

FIG. 1 is a schematic illustration of an example drone 100 in accordance with the teachings of this disclosure. The example drone 100 disclosed herein is a quadcopter drone (viewed from the side in FIG. 1). However, the teachings of this disclosure are applicable to drones, also referred to as unmanned aerial vehicles (UAVs), with any number of rotors or propellers. The example drone 100 includes a body 102 and, in the view of FIG. 1, an example first set of rotors 104 and an example second set of rotors 106. The body 102 houses and/or carries additional components used in the operation of the drone 100. For example, the body 102 houses an example motor 108 and an example motor controller 110. The motor controller 110 controls the motor 108 to rotate the rotors 104, 106 at a target RPMs and/or any other RPMs as disclosed herein. The example drone 100 includes one or more RPM sensors 112 that sense the rotational motion (e.g., RPMs) of the rotors 104, 106. In some examples the RPM sensor(s) 112 include one or more of a vibration sensor, an infra-red rotation sensor, and/or an input current sensor. Also, as noted above, the RPM sensors 112 can be used to detect any type of rotational motion data.

The example drone 100 also includes one or more example audio sensors 114 that gather data from the surrounding environment. In some examples, the audio sensors 114 include acoustic sensors such as, for example, microphones including omnidirectional microphones that detect sound from all directions. In some examples, the audio sensors 114 are an array of microphones. In other examples, other types of acoustic sensors may be used in addition or alternatively to microphones. Additionally, the drone may include sensors to gather other types of data, including, for example, visual data, weather data, etc.

During operation of the drone 100, the rotors 104, 106 produce acoustic waves or self-generated noise 116 due to the blade pass frequency and its higher harmonics. The blade pass frequency is the rate at which the rotors pass by a fixed position and is equal to the number of blades of the rotors multiplied by the RPM of the motor. Thus, the blade pass frequency and, therefore, the self-generated noise 116 varies in pitch (fundamental frequency) and intensity with the number of blades of the rotors 104, 106 and the rotational speed. The self-generated noise 116 obfuscates other acoustic signals gathered by the audio sensors 114. In particular, the self-generated noise 116 shrouds acoustic signals in the surrounding environment including, for example, acoustic signals generated by other drones, acoustic signals from a crowd of people, acoustic signals from traffic, etc.

To process the acoustic signals gathered from the audio sensors 114, the example drone 100 includes an example audio noise reduction module 118. The audio noise reduction module 118, as disclosed in greater detail below, processes the acoustic data gathered from the audio sensors 114 and removes the self-generated noise 116 to yield an audio signal of the external acoustic data for processing, which is unobscured acoustic data from the surrounding environment. The audio noise reduction module 118 uses a cancellation algorithm in which the tracked RPM data are used as reference inputs in a matched filter such as, for example, a Wiener filter, as detailed below. The example drone 100 also includes an example transmitter 120 to transmit the audio signal after noise reduction to an external device.

Figure 2:
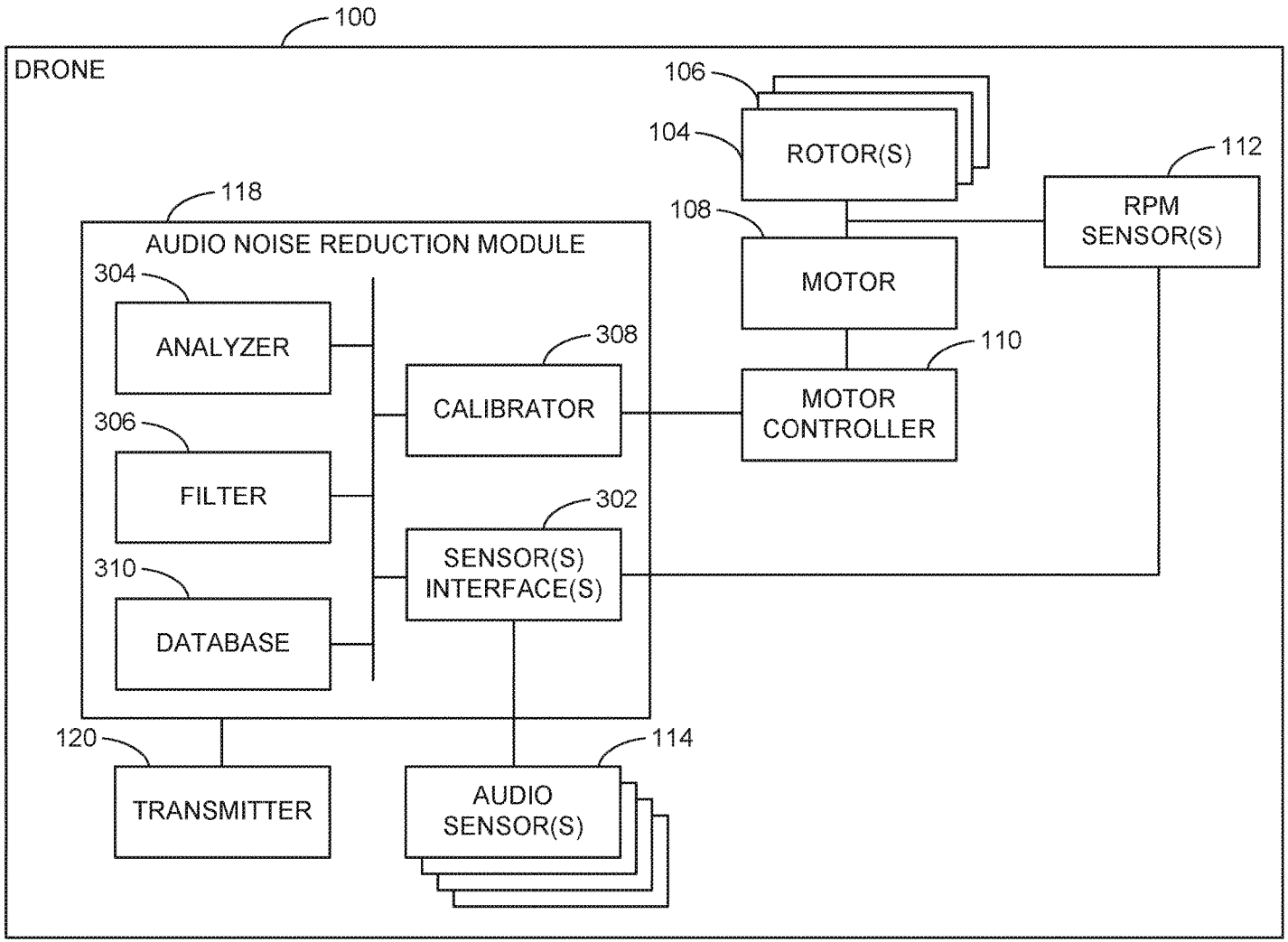
FIG. 2 is a block diagram of the example drone of FIG. 1 with an example audio noise reduction system.

FIG. 2 is a block diagram of the example drone 100 of FIG. 1, which includes the example audio noise reduction module 118 to implement noise reduction in acoustic data gathered by the drone 100. As shown in FIG. 2, the example drone 100 includes the rotors 104, 106, the motor 108, the motor controller 110, the RPM sensors 112, the audio sensors 114, and the transmitter 120. The RPM data gathered from the RPM sensors 112 and the acoustic data gathered from the audio sensors 114 are input into the audio noise reduction module 118 via one or more sensor interfaces 302.

The audio noise reduction module 118 also includes an example analyzer 304 and an example filter 306, which coordinate as means for processing the acoustic data as disclosed herein. The audio noise reduction module 118 further includes a calibrator 308 and database 310, which are also used in the processing of the acoustic data as disclosed herein. In some examples, the audio noise reduction module 118 operates to filter the acoustic data during recordation of the acoustic data and operation of the drone 100. In other examples, the database 310 stores the RPM data with a time stamp for use in filtering and/or other processing at a later point in time. In this example, the acoustic data gathered from the audio sensors 114 may also be stored for post-processing.

When a drone maintains a static flying position, its noise tends to be constant and, therefore, regular single-channel spectral filtering (like a Wiener filter) can be effective to reduce this noise. However, typical drone flying is not static, but is dynamic, which causes tonality variation in the acoustic data over time. Dynamic changes in the tonality occur, for example, with the noise 116 produced by the drone 100 when changing positions and/or flight velocities, when going up or down, and/or when just remaining in one spot in windy conditions. In these situations, the rotors 104, 106 are constantly changing speed, and thus, the tonal characteristics of the noise 116 also change. The audio noise reduction module 118 accounts for these changes by including, for example, in the database 310 a collection of filters mapped to different rotational motion data including, for example, different RPMs.

To establish the mapping of filters and RPMs, the calibrator 308 and motor controller 110 cause the motor 108 to rotate the rotors 104, 106 a desired, set RPMs. The RPM sensors 112 gather RPM data to confirm the rotors 104, 106 are rotating at the desired RPMs. When the rotors 104, 106 are rotating at the desired RPMs, the audio sensors 114 gather acoustic data. In a controlled environment, the measured acoustic data can be determined to be self-generated noise 116 produced by the drone 110. The audio noise reduction module 118 can determine the average amplitude of the frequency spectrum of the self-generated noise 116, which is used to calculate what level of filtering would be effective for eliminating the self-generated noise 116 produced at the desired RPM. In some examples, the calculated filter is a Wiener filter. Other known filtering techniques may also be used.

The audio noise reduction module 118 can also determine different levels of filtering. For example, one filter may be used in one environment and a different filter may be used in a different environment. More specifically, a milder filter that has a relatively lower signal to noise ratio (SNR) gain could provide desired results in a relatively less noisy environment. Whereas a more aggressive filter that has a relatively higher SNR gain could provide desired results in a relatively noisier environment. In some examples, the different filters and/or the different levels of filtering are determined or distinguished by varying filter coefficients to establish the different filters and/or filter levels.

The results indicating what filtering is effective for a particular RPM and desired SNR gain are stored in the database 310. In some examples, the results are stored in a reference such as shown in Table 1.

TABLE 1

| RPM | Mild Filter | Aggressive Filter |
|---|---|---|
| X | Y | Z |
| X + 1 | Y' | Z' |
| X + 2 | Y'' | Z'' |
| X + 3 | Y''' | Z''' |

The calibrator 308 can continue the calibration process through any desired number of RPMs, desired SNR gain, and desired number of rotors to calibrate each with one or more filter(s). The results are mapped and stored in the database 310. The RPM-to-filter mapping is accessed by the analyzer 304 during operation of the drone 100 after the calibration process. In some examples, the audio noise reduction module 118 is provided with pre-calibrated experimental data and the calibration process is avoided.

During operation of the drone 100, a user may wish to record audio signals from the external environment. In this situation, the audio sensors 114 gather raw acoustic data from the environment. The raw acoustic data includes the self-generated noise 116 that obfuscates the desired audio signal namely, a clean audio signal representative of ambient or environmental audio devoid of or with a largely reduced level of the noise 116 generated by the drone 100 itself The raw acoustic data is input into the audio noise reduction module 118 via the sensor interface 302. The sensor interface 302 accepts RPM data gathered from the RPM sensors 112 indicative of the RPM for one or more of the rotors 104, 106 at the time of the gathering of the raw acoustic data.

The analyzer 304 matches the RPM for each rotor with a respective filter using, for example, the mapping disclosed above. The filter 306 filters the raw acoustic data with the filter(s) identified by the analyzer 304. Where multiple rotors are in operation, multiple filters may be used to filter the same raw acoustic data.

In some examples, the audio noise reduction module 118 is set to use a filter with a lower SNR gain to avoid signal distortion. In other examples, the audio noise reduction module 118 is set to use a filter with a higher SNR gain to have a greater noise reduction. In some examples, the audio noise reduction module 118 is set by the manufacturer. In other examples, the user can select the level of SNR gain desired and can change the level at the time of operating the drone 100.

In other examples, the audio noise reduction module 118 can analyze the environment and autonomously select the filtering level. For example, the audio noise reduction module 118 can estimate current SNR in the acoustic data and select a filter based on the SNR. In some examples, the audio noise reduction module 118 processes the acoustic data with a milder filter and then analyzes the SNR in the filtered data. If the SNR is undesirably low, the audio noise reduction module 118 then processes the acoustic data with a more aggressive filter. In operation the audio noise reduction module 118 can monitor the SNR constantly, periodically, or aperiodically, and dynamically adjust the filter level during operation based on the SNR.

In some examples, the analyzer 304 cannot identify a filter that matches exactly with a specific RPM. For example, if the RPM-to-filter mapping includes mapping of RPMs in five RPM increments, the analyzer 304 will not identify a filter for a particular RPM that falls in between the five RPM increments. In this example, the analyzer 304 uses fuzzy logic to identify a hybrid filter that is a combination of two filters for an RPM above the sensed RPM and an RPM below the sensed RPM. The filter 306 then filters the raw acoustic data in accordance with the hybrid filter.

In many examples, the RPM data dynamically changes as the speeds of the rotors 104, 106 change. As the updated RPM data is fed through the sensor interface 302 to the audio noise reduction module 118, the analyzer 304 continues to dynamically select filters associated with the changing RPM data and associates the selected filters with particular moments in time for the raw acoustic data. The filter 306 changes filters as indicated by the analyzer 304 over time. In other examples, the acoustic data and the RPM data is stored in the database 310, for example, and filtered in a post-processing setting where the RPM data is later analyzed to select the one or more filters to be applied to different segments of the acoustic data recorded at different points in time.

Figure 3A:
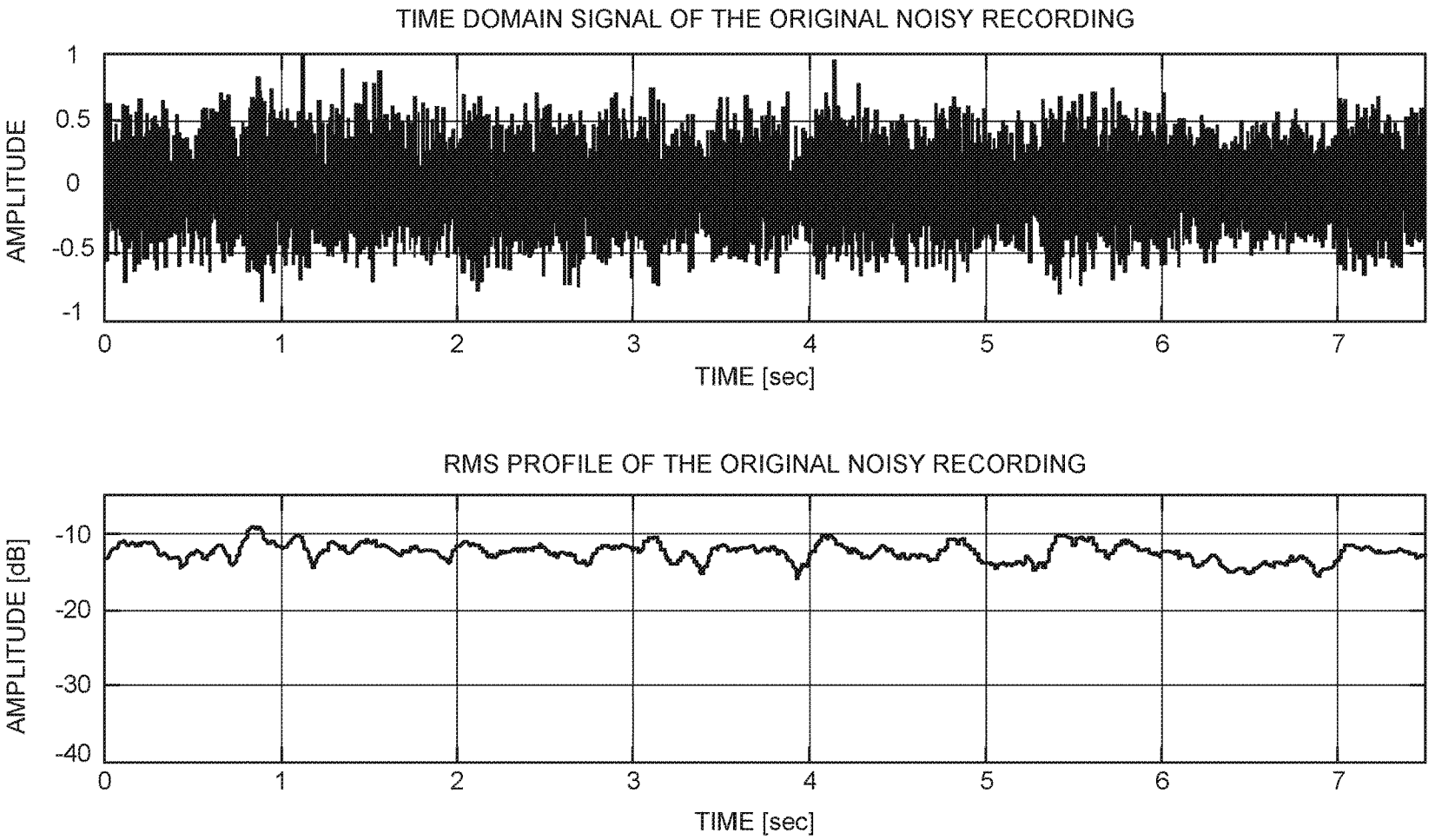
FIG. 3A include graphs of example acoustic data showing an example time domain signal and example root mean square (RMS) profile.
Figure 3B:
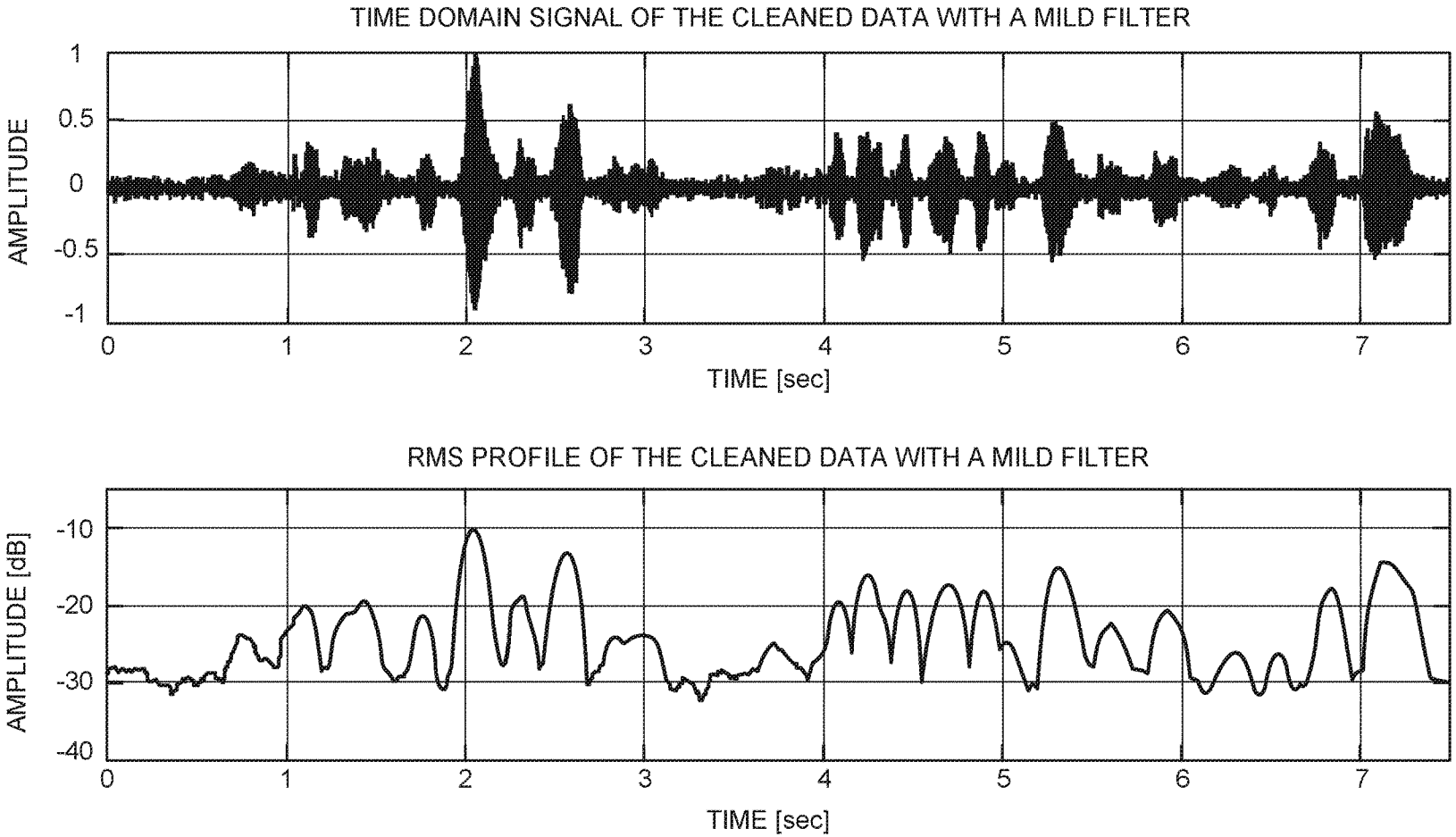
FIG. 3B includes graphs of the example acoustic data of FIG. 3A filtered with a first filter.
Figure 3C:
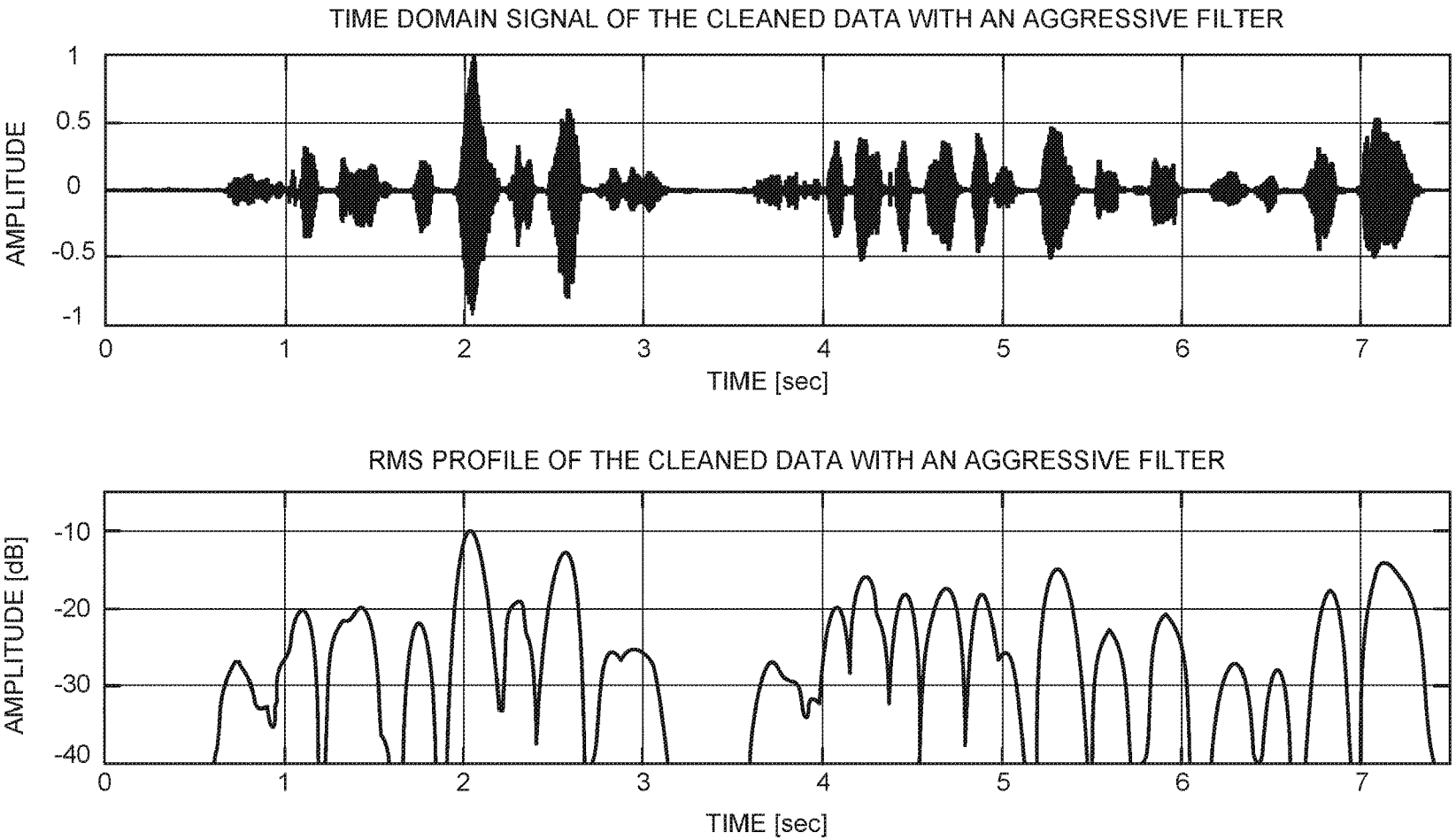
FIG. 3C includes graphs of the example acoustic data of FIG. 3A filtered with a second filter.

FIGS. 3A-3C illustrate example results of filtering acoustic data. FIG. 3A shows an example time domain signal and example root mean square (RMS) profile of raw acoustic data gathered by a drone, for example, the drone 100 of FIGS. 1 and 2. The acoustic data contains noise generated by the drone 100, e.g., the self-generated noise 116, that covers an underlying audio signal. In this example, the underlying audio signal is a person's voice recorded from person speaking about a meter away from the drone 100. The time domain signal is clouded by the noise and does not show the signal representative of the person's voice. The RMS profile shows a relatively consistent decibel level, which also fails to show the varying decibel levels of a person speaking.

FIG. 3B shows an example time domain signal and example RMS profile of the acoustic data of FIG. 3A that has been filtered using a first filter. In this example, the first filter is a relatively mild filter (compared to the filter used to produce the results of FIG. 3C). In this example, the audio noise reduction module 118 uses a first filter that obtains 20 dB of gain. Compared to the signal shown in FIG. 3A, the signal in FIG. 3B has a much higher SNR, and the audio signal of the person's voice is clearly visible, though some noise remains in the signal.

FIG. 3C illustrates an example time domain signal and example RMS profile of the acoustic data of FIG. 3A that has been filtered using a second filter. In this example, the second filter is a relatively more aggressive filter (compared to the filter used to produce the results of FIG. 3B). In this example, the audio noise reduction module 118 uses a second filter that obtains 30 dB of gain. Compared to the signal shown in FIG. 3B, the signal in FIG. 3C has a higher SNR and the audio signal of the person's voice is more clearly visible. There is less noise in the resulting filtered signal of FIG. 3C than that of FIG. 3B. For example, the person whose voice was recorded by the drone 100 stopped speaking, or paused in his speech, between the third and fourth seconds. FIG. 3B shows a small amount of noise at this time, but FIG. 3C shows the absence of an audio signal when there was no speaking. Thus, with the higher SNR and greater gain, the more aggressive filter can provide a clearer audio signal. In some examples, the more aggressive filter can completely eliminate noise. Nonetheless, in some examples, the milder filter is desirable to avoid distortion of the desired audio signal.

Once the self-generated noise 116 is removed (e.g., subtracted, reduced, etc.) from the raw acoustic data, the remaining acoustic data is representative of the external environment.

While an example manner of implementing the drone 100 of FIG. 1 is illustrated in FIG. 2, one or more of the elements, processes and/or devices illustrated in FIG. 2 may be combined, divided, re-arranged, omitted, eliminated and/or implemented in any other way. Further, the example motor controller 110, the example RPM sensors 112, the example audio sensors 114, the example transmitter 120, the example the example sensors interfaces 302, the example analyzer 304, the example filter 306, the example calibrator 308, the example database 310, and/or, more generally, the example audio noise reduction module 118 of FIG. 2 may be implemented by hardware, software, firmware and/or any combination of hardware, software and/or firmware. Thus, for example, any of the example motor controller 110, the example RPM sensors 112, the example audio sensors 114, the example transmitter 120, the example sensors interfaces 302, the example analyzer 304, the example filter 306, the example calibrator 308, the example database 310, and/or, more generally, the example audio noise reduction module 118 of FIG. 2 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example motor controller 110, the example RPM sensors 112, the example audio sensors 114, the example transmitter 120, the example sensors interfaces 302, the example analyzer 304, the example filter 306, the example calibrator 308, the example database 310, and/or the example audio noise reduction module 118 of FIG. 2 is/are hereby expressly defined to include a non-transitory computer readable storage device or storage disk such as a memory, a digital versatile disk (DVD), a compact disk (CD), a Blu-ray disk, etc. including the software and/or firmware. Further still, the example drone 100 of FIG. 1 may include one or more elements, processes and/or devices in addition to, or instead of, those illustrated in FIG. 2, and/or may include more than one of any or all of the illustrated elements, processes and devices.

Figure 4:
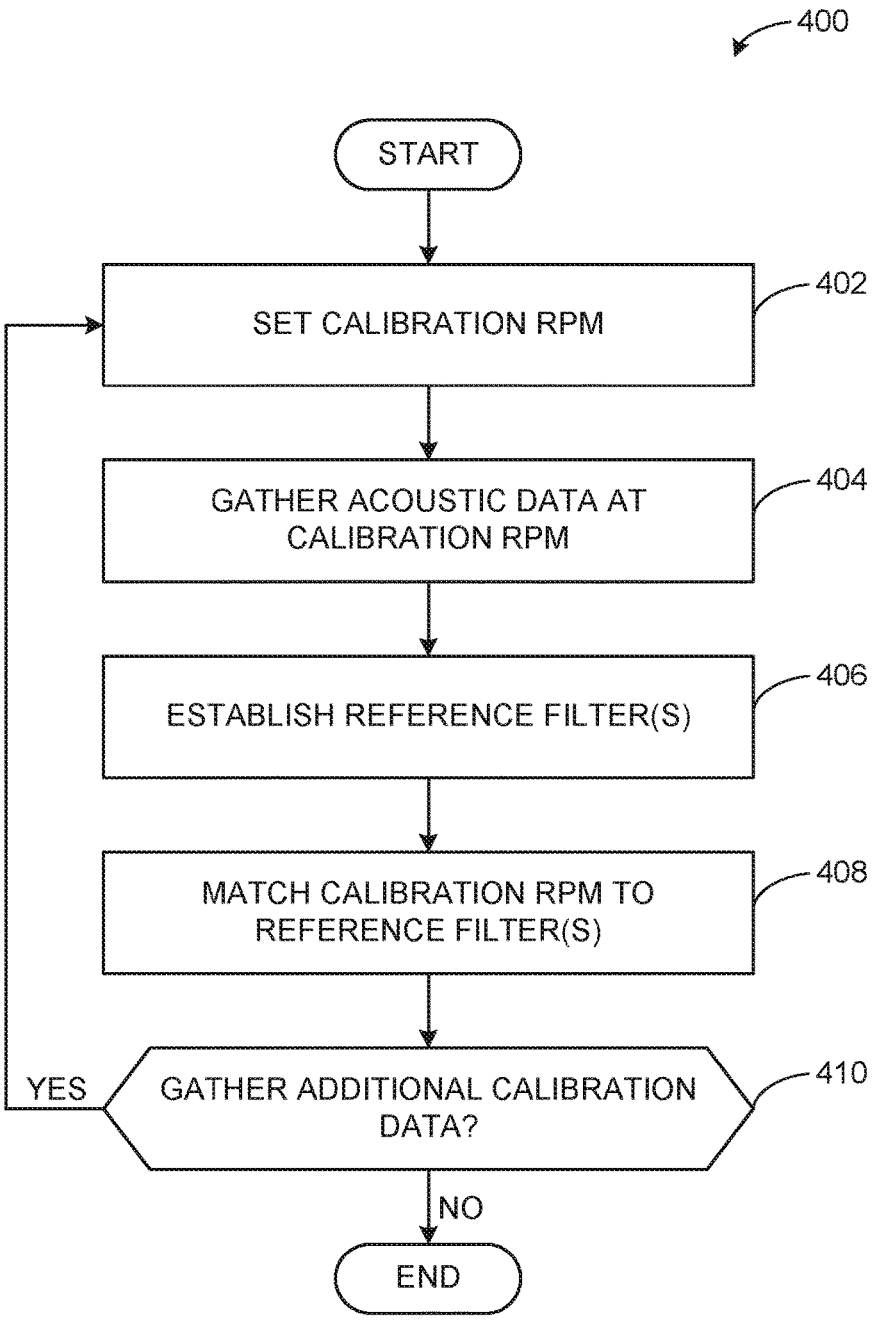
FIG. 4 is a flow chart representative of example machine readable instructions that may be executed to implement calibration of the example audio noise reduction system of FIG. 2.
Figure 5:
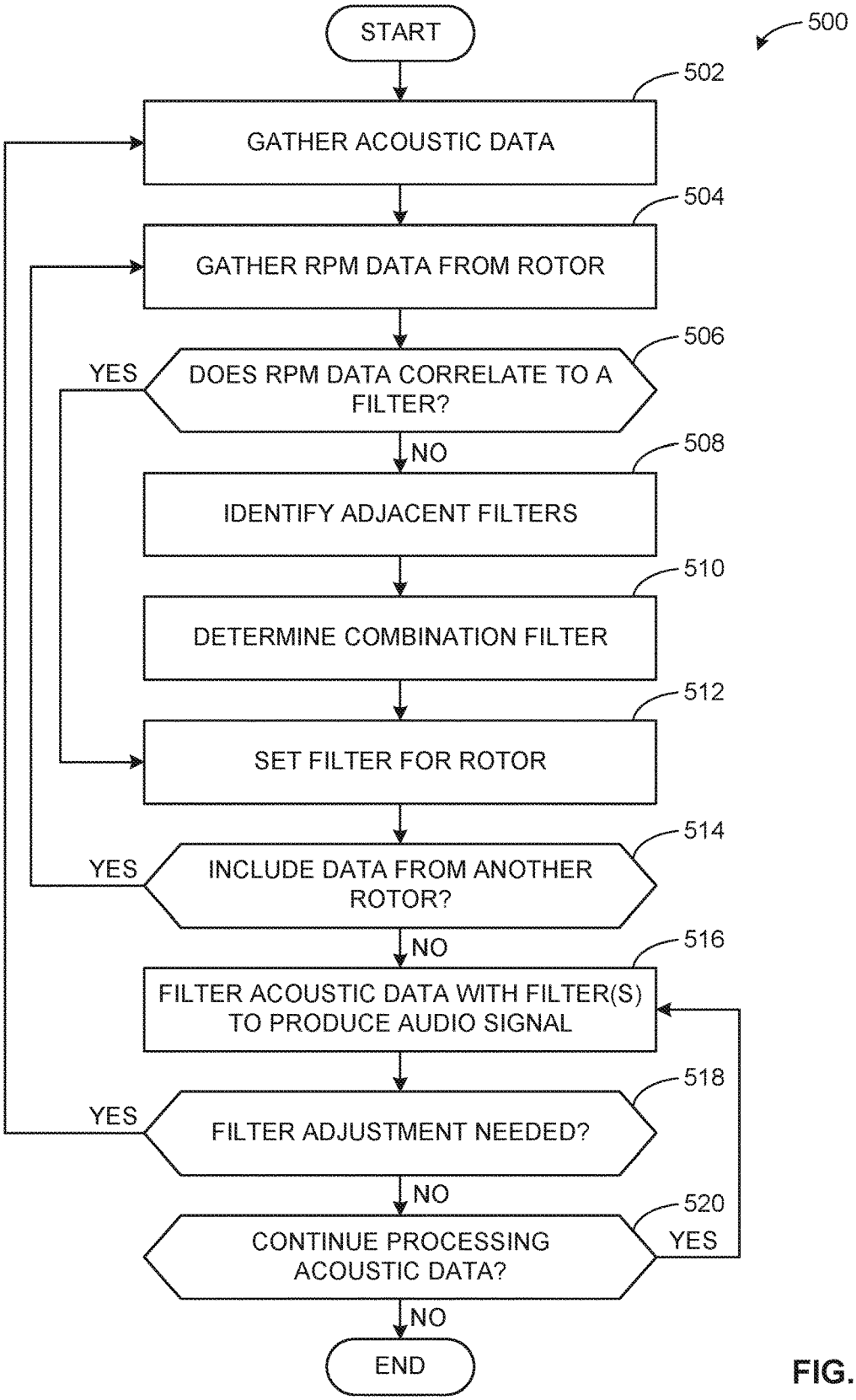
FIG. 5 is a flow chart representative of example machine readable instructions that may be executed to implement the example audio noise reduction system of FIG. 2.

Flowcharts representative of example machine readable instructions for implementing the drone 100 of FIGS. 1 and 2 are shown in FIGS. 4 and 5. In this example, the machine readable instructions comprise processes or programs 400, 500 for execution by a processor such as the processor 612 shown in the example processor platform 600 discussed below in connection with FIG. 6. The programs 400, 500 may be embodied in software stored on a non-transitory computer readable storage medium such as a CD-ROM, a floppy disk, a hard drive, a digital versatile disk (DVD), a Blu-ray disk, or a memory associated with the processor 612, but the entire programs 400, 500 and/or parts thereof could alternatively be executed by a device other than the processor 612 and/or embodied in firmware or dedicated hardware. Further, although the example programs 400, 500 are described with reference to the flowcharts illustrated in FIGS. 4 and 5, respectively, many other methods of implementing the example drone 100 may alternatively be used. For example, the order of execution of the blocks may be changed, and/or some of the blocks described may be changed, eliminated, or combined. Additionally or alternatively, any or all of the blocks may be implemented by one or more hardware circuits (e.g., discrete and/or integrated analog and/or digital circuitry, a Field Programmable Gate Array (FPGA), an Application Specific Integrated circuit (ASIC), a comparator, an operational-amplifier (op-amp), a logic circuit, etc.) structured to perform the corresponding operation without executing software or firmware.

As mentioned above, the example program 400 of FIG. 4 and program 500 of FIG. 5 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. "Including" and "comprising" (and all forms and tenses thereof) are used herein to be open ended terms. Thus, whenever a claim lists anything following any form of "include" or "comprise" (e.g., comprises, includes, comprising, including, etc.), it is to be understood that additional elements, terms, etc. may be present without falling outside the scope of the corresponding claim. As used herein, when the phrase "at least" is used as the transition term in a preamble of a claim, it is open-ended in the same manner as the term "comprising" and "including" are open ended.

The example calibration program 400 of FIG. 4 begins with the calibrator 308 of the audio noise reduction module 118 setting the calibration rotational motion, for example RPM (block 402) to cause the motor controller 110 to operate the motor 108 and rotate the rotors 104, 106 at the calibration RPM. One or more of the audio sensor(s) 114 gather acoustic data (block 404) when the drone 100 is operating at the calibration RPM.

The analyzer 304 analyzes the acoustic data gathered by the audio sensor(s) 114 to determine the amount of noise and establish a reference filter (block 406) for the calibration RPM as detailed above. For example, the analyzer 304 determines the average amplitude in the frequency spectrum for the acoustic data which is used to calculate one or more filters for filtering the noise produced at the calibration RPM. A specific RPM can have multiple filters associated therewith based on, for example, SNR. The analyzer 304 matched the calibration RPM to the reference filter(s) (block 408) and can store the matchings in a reference table such as for example, Table 1 above, in the database 310.

The example calibration program 400 also determines if additional calibration data is to be gathered (block 410). If additional calibration data is to be gathered, the acoustic noise reduction module 118 continues and sets a different calibration RPM (block 402) to obtain further filtering data and build the reference table as disclosed above. If additional calibration data is not to be gathered (block 410), the calibration program 400 ends.

The example operation program 500 of FIG. 5 shows operation of the example drone 100. During operation, acoustic noise reduction module 118 gathers acoustic data (block 502) using, for example, one or more of the acoustic sensor(s) 114, which send acoustic data to the acoustic noise reduction module 118 via the sensor interface(s) 302. The acoustic noise reduction module 118 also gathers rotational motion data, for example RPM data, from the rotor or via rotor observation (block 504) using, for example, one or more of the RPM sensor(s) 112, which send the RPM data to the acoustic noise reduction module 118 via the sensor interface(s) 302.

The analyzer 304 determines if the RPM data correlates to a filter (block 506). For example, the analyzer 304 reviews the RPM data gathered from the RPM sensor(s) 112 and compares the RPM data to RPM data stored in a reference table (e.g., Table 1) in the database 310 to determine if the RPM data matches an RPM in the database 310. Select RPMs are stored in the database 310 and correlated with one or more filters based on, for example, the calibration program 400 of FIG. 4 and/or other information supplied to or programmed with the drone 100.

If the analyzer 304 determines that the RPM data does not match a filter (block 506), the analyzer 304 identifies adjacent filters (block 508). For example, the analyzer 304 identifies filters for the next RPM value above the gathered RPM value and the filters for the next RPM value below the gathered RPM value that are present in the database 310. The analyzer 304 determines a combination filter (block 510) based on the adjacent filters. For example, the analyzer uses fuzzy logic to weigh each filter in accordance with proximity of the gathered RPM value to the respective RPM values associated with the filters in the database 310. With the combination filter determined (block 510), the analyzer 304 sets the filter for the rotor (block 512) operating at that speed.

If the analyzer 304 determines that the RPM data does match a filter in the database 310 (block 506), the analyzer 304 sets the filter for the rotor (block 512) operating at that speed.

The example operation program 500 includes determining if data from another rotor should be included (block 514). For example, the drone 100 includes four rotors 104, 106. The rotors 104, 106 may be operating at different speeds and, therefore, may produce different noise 116. When the rotors 104, 106 produce different noise, the same filter will not effectively filter noise because the filters are tailored for specific noise generated at specific RPMs. If data from one or more additional rotors is to be included (block 514), the acoustic noise reduction module 118 gathers RPM data from the additional rotor(s) (block 504) and continues to identify the appropriate filter as noted above.

If there it is determined that no additional rotor data will be added (block 514), the filter 306 is used to filter the acoustic data with the filter(s) identified for the particular RPMs of the rotor(s) 104, 106 to reduce or eliminate the noise and produce an audio signal (block 516). The audio signal is representative of the acoustic data in the environmental external to the drone 100 without the obscurement caused by the self-generated noise 116 from the rotors 104, 106.

The audio noise reduction module 118 determines if filter adjustment is needed (block 518). For example, the speed (RPMs) of the rotors 104, 106 may change, the previously selected filters may not provide a desired SNR, one or more rotors 104, 106 may start or cease operation, etc. These events could cause a selected filter to provide insufficient filtering. If the audio noise reduction module 118 determines that a filter adjustment is needed (block 518), the audio noise reduction module 118 continues and gathers acoustic data (block 502) and progresses through the operation program 500. If the audio noise reduction module 118 determines that a filter adjustment is not needed (block 518), the acoustic noise reduction module 118 determines if acoustic data is to continue to be processed (block 520). If acoustic data is to continue to be processed, the acoustic noise reduction module 118 continues filtering with the set filters (block 516). If the acoustic noise reduction module 118 determines that acoustic data is no longer to be processed (block 520), the operation program 500 ends.

Figure 6:
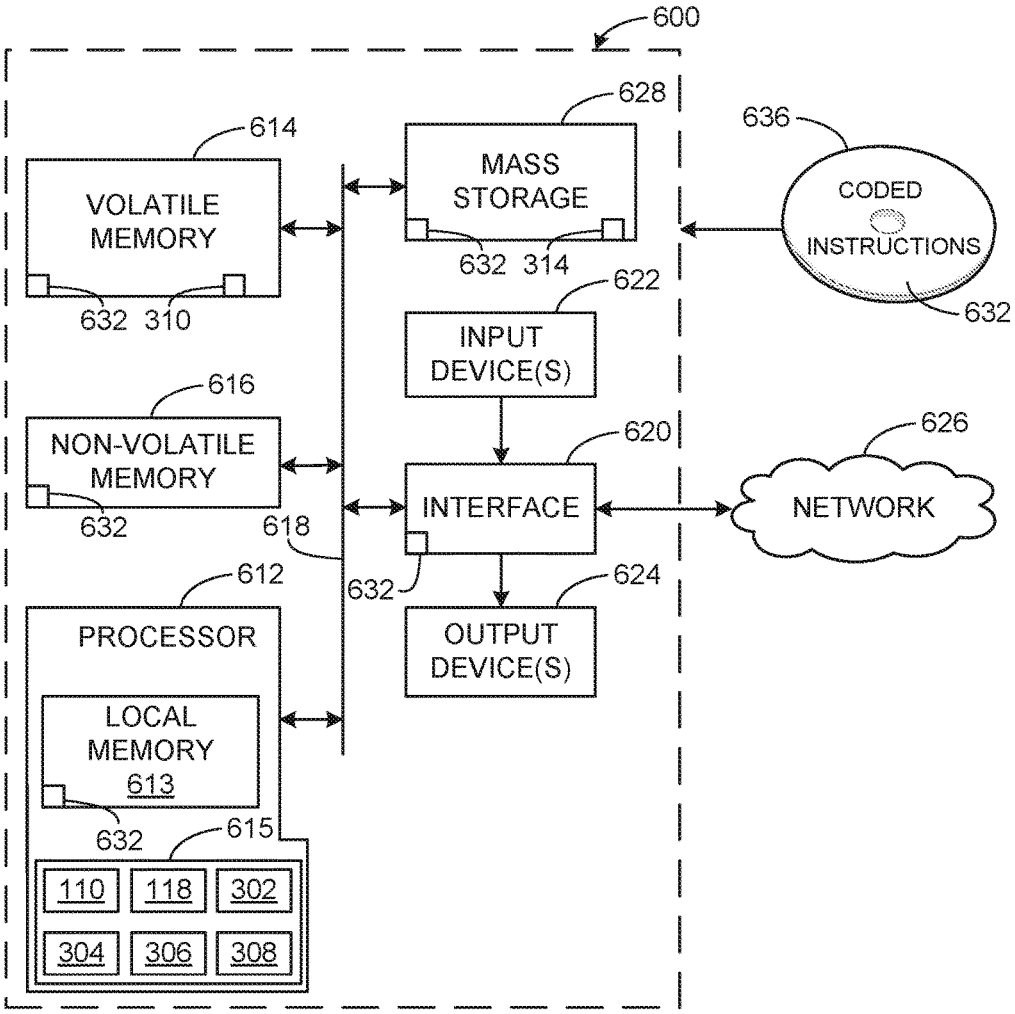
FIG. 6 is a block diagram of an example processor platform structured to execute the example machine readable instructions of FIGS. 4 and 5 to implement the example audio noise reduction system of FIG. 2.

FIG. 6 is a block diagram of an example processor platform 500 capable of executing the instructions of FIGS. 4 and 5 to implement the apparatus of FIGS. 1 and 2. The processor platform 600 can be, for example, a server, a personal computer, a mobile device (e.g., a cell phone, a smart phone, a tablet such as an iPad™), a personal digital assistant (PDA), an Internet appliance, a DVD player, a CD player, a digital video recorder, a Blu-ray player, a gaming console, a personal video recorder, a set top box, or any other type of computing device.

The processor platform 600 of the illustrated example includes a processor 612. The processor 612 of the illustrated example is hardware. For example, the processor 612 can be implemented by one or more integrated circuits, logic circuits, microprocessors or controllers from any desired family or manufacturer. The hardware processor may be a semiconductor based (e.g., silicon based) device. In this example, the processor implements the example motor controller 110, the example the example sensors interfaces 302, the example analyzer 304, the example filter 306, the example calibrator 308, and/or the example audio noise reduction module 118 of FIG. 2.

The processor 612 of the illustrated example includes a local memory 613 (e.g., a cache). The processor 612 of the illustrated example is in communication with a main memory including a volatile memory 614 and a non-volatile memory 616 via a bus 618. The volatile memory 614 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 616 may be implemented by flash memory and/or any other desired type of memory device. Access to the main memory 614, 616 is controlled by a memory controller.

The processor platform 600 of the illustrated example also includes an interface circuit 620. The interface circuit 620 may be implemented by any type of interface standard, such as an Ethernet interface, a universal serial bus (USB), and/or a PCI express interface.

In the illustrated example, one or more input devices 622 are connected to the interface circuit 620. The input device(s) 622 permit(s) a user to enter data and/or commands into the processor 612. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 624 are also connected to the interface circuit 620 of the illustrated example. The output devices 624 can be implemented, for example, by display devices (e.g., a light emitting diode (LED), an organic light emitting diode (OLED), a liquid crystal display, a cathode ray tube display (CRT), a touchscreen, a tactile output device, a printer and/or speakers). The interface circuit 620 of the illustrated example, thus, typically includes a graphics driver card, a graphics driver chip and/or a graphics driver processor.

The interface circuit 620 of the illustrated example also includes a communication device such as a transmitter, a receiver, a transceiver, a modem and/or network interface card to facilitate exchange of data with external machines (e.g., computing devices of any kind) via a network 626 (e.g., an Ethernet connection, a digital subscriber line (DSL), a telephone line, coaxial cable, a cellular telephone system, etc.).

The processor platform 600 of the illustrated example also includes one or more mass storage devices 628 for storing software and/or data. Examples of such mass storage devices 628 include floppy disk drives, hard drive disks, compact disk drives, Blu-ray disk drives, RAID systems, and digital versatile disk (DVD) drives.

The coded instructions 632 of FIG. 6 may be stored in the mass storage device 628, in the volatile memory 614, in the non-volatile memory 616, and/or on a removable tangible computer readable storage medium such as a CD or DVD.

From the foregoing, it will be appreciated that example methods, apparatus and articles of manufacture have been disclosed that advance audio operations of drones by enabling drones to record ambient audio.

Prior audio recordings with drones are drowned out by the noise produced by the drone or require limited directional microphones and costly and expensive hardware add-ons. The examples of this disclosure provide a novel way to deal with rotor noise that has minimal or no additional hardware and low computational overhead.

In the examples disclosed herein, no additional hardware is required to record audio signals from the surrounding environment and reduce noise in the gathered acoustic signals. Rotor speed information is already available from existing sensors or from a rotor controller. Many present commercial drones already have some sort of RPM sensor built-in for flight control purposes. The examples of this disclosure leverage this RPM data in a new way and without requiring any additional hardware.

Furthermore, the example disclosed herein provide improved performance with reduced overhead because the pre-calibration of the filters with respect to motor/rotor speed enables the reference table approach to select high quality filters such as, for example, Wiener filters, while minimizing computing cost.

Example methods, apparatus, systems and articles of manufacture for drone audio noise reduction are disclosed herein. Further examples and combinations thereof include the following.

Example 1 is an apparatus to reduce audio noise from a drone. The example apparatus includes a first sensor to gather acoustic data and a second sensor to gather rotational motion data of a rotor. The example apparatus also includes an analyzer to match the rotational motion data to a filter and filter the acoustic data using the filter. The analyzer also is to generate an audio signal based on the filtered acoustic data.

Example 2 includes the apparatus of Example 1, wherein the first sensor is an omnidirectional microphone.

Example 3 includes the apparatus of Example 1, wherein the analyzer is to filter the acoustic data during the rotational motion of the rotor.

Example 4 includes the apparatus of any of Examples 1-3, wherein the filter is a first filter and the analyzer is to match the rotational motion data to the first filter by: identifying a second filter of a rotational motion value greater than the rotational motion data; identifying a third filter of a rotational motion value lower than the rotational motion data; and using a combination of the second filter and the third filter as the first filter.

Example 5 includes the apparatus of any of Examples 1-3, wherein the rotational motion data is first rotational motion data, the filter is a first filter, and the rotor is a first rotor. In the apparatus of Example 5, the second sensor or a third sensor is to gather second rotational motion data of a second rotor, and the analyzer is to further: match the second rotational motion data to a second filter; and filter the acoustic with the second filter.

Example 6 includes the apparatus of any of Examples 1-3, wherein the rotational motion data is first rotational motion data gathered at a first time, the filter is a first filter, and the audio signal is a first audio signal at the first time. In the apparatus of Example 6, the second sensor is to gather second rotational motion data of the rotor at a second time, the second rotational motion data having a value different than the first rotational motion data, and the analyzer is to further: match the second rotational motion data to a second filter, the second filter different than the first filter; filter the acoustic data with the second filter; and generate a second audio signal at the second time based on the filtering of the acoustic data with the second filter.

Example 7 includes the apparatus of any of Examples 1-3, wherein the analyzer is to identify ground-based activity based on the audio signal.

Example 8 includes the apparatus of any of Examples 1-3 and further including a controller to set the rotor to a first calibration rotational motion. In the apparatus of Example 8, the first sensor is to gather first preliminary acoustic data when the rotor is set at the first calibration rotational motion, and the analyzer is to establish a first reference filter based on the first preliminary acoustic data and match the first calibration rotational motion to the first reference filter. In the apparatus of Example 8, the controller is to set the rotor to a second calibration rotational motion, the first sensor is to gather second preliminary acoustic data when the rotor is set at the second calibration rotational motion, and the analyzer is to establish a second reference filter based on the second preliminary acoustic data and match the second calibration rotational motion to the second reference filter. Also, in the apparatus of Example 8, the analyzer matches the rotational motion data to a filter by: determining which of the first calibration rotational motion or the second calibration rotational motion is closer in value to the rotational motion data; selecting between the first reference filter and the second reference filter associated with the first calibration rotational motion or the second calibration rotational motion that is closer is in value to the rotational motion data; and using the selected first reference filter or second reference filter as the filter.

Example 9 include the apparatus of Example 8, wherein the analyzer is to establish the first reference filter by: converting the first preliminary acoustic data into the frequency domain; determining an average amplitude of the frequency spectrum; and performing spectral subtraction based on the average amplitude of the frequency spectrum.

Example 10 includes the apparatus of Example 8, wherein the analyzer is to establish the first reference filter based on a signal-to-noise ratio gain.

Example 11 is a method of reducing audio noise from a drone. The method of Example 11 includes establishing, by executing an instruction with a processor, a filter for rotational motion data gathered from a rotor; filtering, by executing an instruction with a process, acoustic data gathered from the drone using the filter; and generating, by executing an instruction with a process, an audio signal based on the filtered acoustic data.

Example 12 includes the method of Example 11 and further includes gathering the acoustic data with an omnidirectional microphone.

Example 13 includes the method of Example 11 and further includes filtering the acoustic data during the gathering of the rotational motion data.

Example 14 includes the method of any of Examples 11-13, wherein the filter is a first filter and matching the rotational motion data to the first filter. In addition, the method of Example 14 further includes: identifying a second filter of a rotational motion value greater than the rotational motion data; identifying a third filter of a rotational motion value lower than the rotational motion data; and using a combination of the second filter and the third filter as the first filter.

Example 15 includes the method of any of Examples 11-13, wherein the rotational motion data is first rotational motion data, the filter is a first filter, and the rotor is a first rotor. In addition, the method of Example 15 further includes: establishing a second filter for second rotational motion data gathered from a second rotor; and filtering the acoustic with the second filter.

Example 16 includes the method of any of Examples 11-13, wherein the rotational motion data is first rotational motion data gathered at a first time, the filter is a first filter, and the audio signal is a first audio signal at the first time. The method of Example 16 further includes: establishing a second filter for second rotational motion data gathered from the rotor at a second time, the second rotational motion data having a value different than the first rotational motion data, the second filter different than the first filter; filtering the acoustic data with the second filter; and generating a second audio signal at the second time based on the filtering of the acoustic data with the second filter.

Example 17 includes the method of any of Examples 11-13, and further includes identifying ground-based activity based on the audio signal.

Example 18 includes the method of any of Examples 11-13, and further includes: setting the rotor to a first calibration rotational motion; gathering first preliminary acoustic data when the rotor is set at the first calibration rotational motion; establishing a first reference filter based on the first preliminary acoustic data; matching the first calibration rotational motion to the first reference filter; setting the rotor to a second calibration rotational motion; gathering second preliminary acoustic data when the rotor is set at the second calibration rotational motion; establishing a second reference filter based on the second preliminary acoustic data; and matching the second calibration rotational motion to the second reference filter. In the method of Example 18, matching the rotational motion data to a filter includes: determining which of the first calibration rotational motion or the second calibration rotational motion is closer in value to the rotational motion data; selecting between the first reference filter and the second reference filter associated with the first calibration rotational motion or the second calibration rotational motion that is closer is in value to the rotational motion data; and using the selected first reference filter or second reference filter as the filter.

Example 19 includes the method of Example 18, wherein establishing the first reference filter includes: converting the first preliminary acoustic data into the frequency domain; determining an average amplitude of the frequency spectrum; and performing spectral subtraction based on the average amplitude of the frequency spectrum.

Example 20 includes the method of Example 18, wherein establishing the first reference filter is based on a signal-to-noise ratio gain.

Example 21 is a drone that includes a rotor and a motor to rotate the rotor. The drone of Example 21 also includes means for gathering acoustic data and means for gathering revolutions per minute (rotational motion) data of a rotor. In addition, the drone of Example 21 includes means for processing the acoustic data and the rotational motion data by: matching the rotational motion data to a filter; filtering the acoustic data using the filter; and generating an audio signal based on the filtered acoustic data.

Example 22 includes the drone of Example 21, wherein the means for gathering acoustic data includes an omnidirectional microphone.

Example 23 includes the drone of Example 21, wherein the means for gathering rotational motion data includes at least one of a vibration sensor, an infra-red rotation sensor, or an input current sensor.

Example 24 includes the drone of any of Examples 21-23, wherein the filter is a first filter and the means for processing is to match the rotational motion data to the first filter by: identifying a second filter of a rotational motion value greater than the rotational motion data; identifying a third filter of a rotational motion value lower than the rotational motion data; and using a combination of the second filter and the third filter as the first filter.

Example 25 includes the drone of any of Examples 21-23, wherein the rotational motion data is first rotational motion data, the filter is a first filter, and the rotor is a first rotor. In the drone of Example 25, the means for gathering rotational motion data is to gather second rotational motion data of a second rotor, and the means for processing is to: match the second rotational motion data to a second filter; and filter the acoustic with the second filter.

Example 26 includes the drone of any of Examples 21-23, wherein the rotational motion data is first rotational motion data gathered at a first time, the filter is a first filter, and the audio signal is a first audio signal at the first time. In the drone of Example 26, the means for gathering rotational motion data is to gather second rotational motion data of the rotor at a second time, the second rotational motion data having a value different than the first rotational motion data. Also in the drone of Example 26, the means for processing is to further: match the second rotational motion data to a second filter, the second filter different than the first filter; filter the acoustic data with the second filter; and generate a second audio signal at the second time based on the filtering of the acoustic data with the second filter.

Example 27 includes the drone of any of Examples 21-23, wherein the means for processing is to identify ground-based activity based on the audio signal.

Example 28 includes the drone of any of Examples 21-23, and further including means for controlling the motor that is to set the rotor to a first calibration rotational motion, wherein the means for gathering acoustic data is to gather first preliminary acoustic data when the rotor is set at the first calibration rotational motion, and the means for processing is to establish a first reference filter based on the first preliminary acoustic data and match the first calibration rotational motion to the first reference filter. In the drone of Example 28, the means for controlling the motor also is to set the rotor to a second calibration rotational motion, wherein the means for gathering acoustic data is to gather second preliminary acoustic data when the rotor is set at the second calibration rotational motion, and the means for processing is to establish a second reference filter based on the second preliminary acoustic data and match the second calibration rotational motion to the second reference filter. In addition, in the drone of Example 28, the means for processing matches the rotational motion data to a filter by: determining which of the first calibration rotational motion or the second calibration rotational motion is closer in value to the rotational motion data; selecting between the first reference filter and the second reference filter associated with the first calibration rotational motion or the second calibration rotational motion that is closer is in value to the rotational motion data; and using the selected first reference filter or second reference filter as the filter.

Example 29 includes the drone of Example 28, wherein the means for processing is to establish the first reference filter by: converting the first preliminary acoustic data into the frequency domain; determining an average amplitude of the frequency spectrum; and performing spectral subtraction based on the average amplitude of the frequency spectrum.

Example 30 includes the drone of Example 28, wherein the means for processing is to establish the first reference filter based on a signal-to-noise ratio gain.

Example 31 is a non-transitory computer readable storage medium comprising computer readable instructions that, when executed, cause one or more processors to at least: match rotational motion data gathered from a rotor to a filter; filter acoustic data gathered from the drone using the filter; and generate an audio signal based on the filtered acoustic data.

Example 32 include the storage medium as defined in Example 31, wherein the computer readable instructions, when executed, further cause the processor to gather the acoustic data with an omnidirectional microphone.

Example 33 includes the storage medium as defined in Example 31, wherein the computer readable instructions, when executed, further cause the processor to filter the acoustic data during the rotational motion.

Example 34 includes the storage medium as defined in any of Examples 31-33, wherein the filter is a first filter and the computer readable instructions, when executed, further cause the processor match the rotational motion data to the first filter by: identifying a second filter of an rotational motion value greater than the rotational motion data; identifying a third filter of an rotational motion value lower than the rotational motion data; and using a combination of the second filter and the third filter as the first filter.

Example 35 includes the storage medium as defined in any of Examples 31-33, wherein the rotational motion data is first rotational motion data, the filter is a first filter, and the rotor is a first rotor. The storage medium of Example 35 includes computer readable instructions that, when executed, further cause the processor to match second rotational motion data gathered from a second rotor to a second filter and filter the acoustic with the second filter.

Example 36 includes the storage medium as defined in any of Examples 31-33, wherein the rotational motion data is first rotational motion data gathered at a first time, the filter is a first filter, and the audio signal is a first audio signal at the first time. The storage medium of Example 36 includes computer readable instructions that, when executed, further cause the processor to: match second rotational motion data gathered from the rotor at a second time to a second filter, the second rotational motion data having a value different than the first rotational motion data, the second filter different than the first filter; filter the acoustic data with the second filter; and generate a second audio signal at the second time based on the filtering of the acoustic data with the second filter.

Example 37 includes the storage medium as defined in any of Examples 31-33, wherein the computer readable instructions, when executed, further cause the processor to identify ground-based activity based on the audio signal.

Example 38 includes the storage medium as defined in any of Examples 31-33, wherein the computer readable instructions, when executed, further cause the processor to: set the rotor to a first calibration rotational motion; gather first preliminary acoustic data when the rotor is set at the first calibration rotational motion; establish a first reference filter based on the first preliminary acoustic data; match the first calibration rotational motion to the first reference filter; set the rotor to a second calibration rotational motion; gather second preliminary acoustic data when the rotor is set at the second calibration rotational motion; establish a second reference filter based on the second preliminary acoustic data; and match the second calibration rotational motion to the second reference filter. The storage medium of Example 38 also includes computer readable instructions that, when executed, cause the processor to match the rotational motion data to a filter by: determining which of the first calibration rotational motion or the second calibration rotational motion is closer in value to the rotational motion data; selecting between the first reference filter and the second reference filter associated with the first calibration rotational motion or the second calibration rotational motion that is closer is in value to the rotational motion data; and using the selected first reference filter or second reference filter as the filter.

Example 39 includes the storage medium as defined in Example 38, wherein the computer readable instructions, when executed, further cause the processor to establish the first reference filter by: converting the first preliminary acoustic data into the frequency domain; determining an average amplitude of the frequency spectrum; and performing spectral subtraction based on the average amplitude of the frequency spectrum.

Example 40 includes the storage medium as defined in Example 39, wherein the computer readable instructions, when executed, further cause the processor to further establish the first reference filter based on a signal-to-noise ratio gain.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus to reduce audio noise from a drone, the apparatus comprising:

a first sensor to gather acoustic data;

a second sensor to gather rotational motion data of a rotor; and an analyzer to:

identify a rotational motion value from the rotational motion data;

identify a first filter that matches a rotational motion value greater than the identified rotational motion value;

identify a second filter that matches a rotational motion value lower than the identified rotational motion value;

filter the acoustic data into filtered acoustic data with a combination of the first identified filter and the second identified filter as a matching filter; and generate an audio signal based on the filtered acoustic data.

2. The apparatus of claim 1, wherein the first sensor is an omnidirectional microphone.

3. The apparatus of claim 1, wherein the analyzer is to filter the acoustic data during the rotational motion of the rotor.

4. The apparatus of claim 1, wherein the rotational motion data is first rotational motion data and the rotor is a first rotor, wherein the second sensor or a third sensor is to gather second rotational motion data of a second rotor, and the analyzer is to further:

match the second rotational motion data to a third filter; and filter the acoustic data into the filtered acoustic data with the matching filter and the third identified filter.

5. The apparatus of claim 1, wherein the rotational motion data is first rotational motion data gathered at a first time and the audio signal is a first audio signal at the first time, wherein the second sensor is to gather second rotational motion data of the rotor at a second time, the second rotational motion data having a value different than the first rotational motion data, and the analyzer is to further:

identify a third filter that matches the second rotational motion data, the third identified filter different than the matching filter;

filter the acoustic data gathered at the second time into second filtered acoustic data using the third identified filter; and generate a second audio signal based on the second filtered acoustic data.

6. The apparatus of claim 1, wherein the analyzer is to identify ground-based activity based on the audio signal.

7. The apparatus of claim 1, further including a controller to:

set the rotor to a first calibration rotational motion, the first sensor to gather first preliminary acoustic data when the rotor is set at the first calibration rotational motion, and set the rotor to a second calibration rotational motion, the first sensor to gather second preliminary acoustic data when the rotor is set at the second calibration rotational motion; and the analyzer to:

establish a first reference filter based on the first preliminary acoustic data and correlate the first calibration rotational motion with the first reference filter, establish a second reference filter based on the second preliminary acoustic data and correlate the second calibration rotational motion with the second reference filter, determine which of the first calibration rotational motion or the second calibration rotational motion is closer in value to the rotational motion data;

select between the first reference filter associated with the first calibration rotational motion and the second reference filter associated with the second calibration rotational motion based on which of the first calibration rotational motion or the second calibration rotational motion is closer in value to the rotational motion data; and use the selected first reference filter or the second reference filter to filter the acoustic data into the filtered acoustic data.

8. The apparatus of claim 7, wherein the analyzer is to establish the first reference filter by:

converting the first preliminary acoustic data into the frequency domain;

determining an average amplitude of the frequency spectrum; and performing spectral subtraction based on the average amplitude of the frequency spectrum.

9. The apparatus of claim 7, wherein the analyzer is to establish the first reference filter based on a signal-to-noise ratio gain.

10. A method of reducing audio noise from a drone, the method comprising:

identifying, by executing an instruction with a processor, a rotational motion value from rotational motion data gathered from a rotor;

identifying, by executing an instruction with the processor, a first filter that matches a rotational motion value greater than the identified rotational motion value;

identifying, by executing an instruction with the processor, a second filter that matches a rotational motion value lower than the identified rotational motion value;

using, by executing an instruction with the processor, a combination of the first identified filter and the identified second filter as a matching filter to filter acoustic data gathered from the drone into filtered acoustic data; and generating, by executing an instruction with the processor, an audio signal based on the filtered acoustic data.

11. The method of claim 10, wherein the rotational motion data is first rotational motion data and the rotor is a first rotor, the method further including:

establishing, by executing an instructions with the processor, a third filter for second rotational motion data gathered from a second rotor; and filtering, by executing an instruction with a processor, the acoustic data into filtered acoustic data with the matching filter and the third identified filter.

12. The method of claim 10, wherein the rotational motion data is first rotational motion data gathered at a first time and the audio signal is a first audio signal at the first time, the method further including:

establishing, by executing an instruction with the processor, a third filter for second rotational motion data gathered from the rotor at a second time, the second rotational motion data having a value different than the first rotational motion data, the third identified filter different than the matching filter;

filtering, by executing an instruction with the processor, acoustic data gathered from the drone at the second time into second filtered acoustic data using the third established filter; and generating, by executing an instruction with the processor, a second audio signal based on the second filtered acoustic data.

13. The method of claim 10, further including:

setting, by executing an instruction with a processor, the rotor to a first calibration rotational motion;

gathering, by executing an instruction with the processor, first preliminary acoustic data when the rotor is set at the first calibration rotational motion;

establishing, by executing an instruction with the processor, a first reference filter based on the first preliminary acoustic data;

associating the first calibration rotational motion with the first reference filter;

setting, by executing an instruction with the processor, the rotor to a second calibration rotational motion;

gathering second preliminary acoustic data when the rotor is set at the second calibration rotational motion;

establishing, by executing an instruction with the processor, a second reference filter based on the second preliminary acoustic data; and associating the second calibration rotational motion with the second reference filter;

determining, by executing an instruction with the processor, which of the first calibration rotational motion or the second calibration rotational motion is closer in value to the rotational motion data;

selecting, by executing an instruction with the processor, between the first reference filter associated with the first calibration rotational motion and the second reference filter associated with the second calibration rotational motion based on which of the first calibration rotational motion or the second calibration rotational motion is closer in value to the rotational motion data; and filtering the acoustic data into the filtered acoustic data with the selected first reference filter or the second reference filter.

14. The method of claim 13, wherein establishing the first reference filter includes:

converting the first preliminary acoustic data into the frequency domain;

determining an average amplitude of the frequency spectrum; and performing spectral subtraction based on the average amplitude of the frequency spectrum.

15. The method of claim 10, further including filtering the acoustic data during the rotational motion of the rotor.

16. A drone, comprising:

a rotor;

a motor to rotate the rotor;

means for gathering acoustic data;

means for gathering rotational motion data of the rotor; and means for processing the acoustic data and the rotational motion data by:

identifying a rotational motion value from the rotational motion data;

identifying a first filter that matches a rotational motion value greater than the identified rotational motion value;

identifying a second filter that matches a rotational motion value lower than the identified rotational motion value;

filtering the acoustic data into the filtered acoustic data with a combination of the first identified filter and the second identified filter as a matching filter; and generating an audio signal based on the filtered acoustic data.

17. The drone of claim 16, wherein the rotational motion data is first rotational motion data and the rotor is a first rotor, wherein the means for gathering rotational motion data is to gather second rotational motion data of a second rotor, and the means for processing is to:

identify a third filter that matches the second rotational motion data; and filter the acoustic data into the filtered acoustic data with the matching filter and the third identified filter.

18. The drone of claim 16, wherein the rotational motion data is first rotational motion data gathered at a first time, the audio signal is a first audio signal at the first time, and the means for gathering rotational motion data is to gather second rotational motion data of the rotor gathered at a second time, the second rotational motion data having a value different than the first rotational motion data, and the means for processing is to further:

identify a third filter that matches the second rotational motion data, the third identified filter different than the matching filter;

filter the acoustic data gathered at the second time into second filtered acoustic data with the third identified filter; and generate a second audio signal based on the second filtered acoustic data.

19. The drone of claim 16, further including means for controlling the motor, the controlling means to:

set the rotor to a first calibration rotational motion, the means for gathering acoustic data to gather first preliminary acoustic data when the rotor is set at the first calibration rotational motion, and set the rotor to a second calibration rotational motion, the means for gathering acoustic data to gather second preliminary acoustic data when the rotor is set at the second calibration rotational motion; and the means for processing the acoustic data and the rotational motion data is to:

establish a first reference filter based on the first preliminary acoustic data, associate the first calibration rotational motion with the first reference filter, establish a second reference filter based on the second preliminary acoustic data, associate the second calibration rotational motion with the second reference filter, determine which of the first calibration rotational motion or the second calibration rotational motion is closer in value to the rotational motion data;

select between the first reference filter associated with the first calibration rotational motion and the second reference filter associated with the second calibration rotational motion based on which of the first calibration rotational motion or the second calibration rotational motion is closer in value to the rotational motion data; and filter the acoustic data into the filtered acoustic data with the selected first reference filter or the second reference filter.

20. The drone of claim 16, wherein the means for processing the acoustic data and the rotational motion data is to filter the acoustic data during the rotational motion of the rotor.

21. A non-transitory computer readable storage medium comprising computer readable instructions that, when executed, cause one or more processors to at least:

identify a rotational motion value from rotational motion data gathered from a rotor of a drone;

identify a first filter that matches a rotational motion value greater than the identified rotational motion value;

identify a second filter that matches a rotational motion value lower than the rotational motion value;

filter acoustic data gathered from the drone into the filtered acoustic data with a combination of the first identified filter and the second identified filter as a matching filter; and generate an audio signal based on the filtered acoustic data.

22. The storage medium as defined in claim 21, wherein the rotational motion data is first rotational motion data, the rotor is a first rotor, and the computer readable instructions, when executed, further cause the processor to:

identify a third filter that matches second rotational motion data gathered from a second rotor; and filter acoustic data gathered from the drone into the filtered acoustic data using the matching filter and the third identified filter.

23. The storage medium as defined in claim 21, wherein the rotational motion data is first rotational motion data gathered at a first time, the audio signal is a first audio signal at the first time, and the computer readable instructions, when executed, further cause the processor to:

identify a third filter that matches second rotational motion data gathered from the rotor at a second time, the second rotational motion data having a value different than the first rotational motion data, the third identified filter different than the matching filter;

filter acoustic data gathered from the drone at the second time into second filtered acoustic data using the third identified filter; and generate a second audio signal based on the second filtered acoustic data.

24. The storage medium as defined in claim 21, wherein the computer readable instructions, when executed, further cause the processor to filter the acoustic data during the rotational motion of the rotor.

* * * * *